US006766726B1

(12) United States Patent
Schwarzkopf

(10) Patent No.: US 6,766,726 B1
(45) Date of Patent: Jul. 27, 2004

(54) AXIAL PISTON DISPLACEMENT COMPRESSOR

(75) Inventor: Otfried Schwarzkopf, Magstadt (DE)

(73) Assignee: Zexel Valeo Compressor Europe GmbH, Weiterstadt (DE)

( * ) Notice: Subject to any disclaimer, the term of this patent is extended or adjusted under 35 U.S.C. 154(b) by 0 days.

(21) Appl. No.: 10/089,559

(22) PCT Filed: Oct. 4, 2000

(86) PCT No.: PCT/EP00/09705

§ 371 (c)(1),
(2), (4) Date: Jul. 8, 2002

(87) PCT Pub. No.: WO01/25635

PCT Pub. Date: Apr. 12, 2001

(30) Foreign Application Priority Data

Oct. 4, 1999 (DE) ..... 199 47 677

(51) Int. Cl.[7] ..... F01B 3/00
(52) U.S. Cl. ..... 92/12.2; 92/71
(58) Field of Search ..... 92/71, 12.2; 91/505, 91/506; 417/222.1; 74/839

(56) References Cited

U.S. PATENT DOCUMENTS 4,674,957 A 6/1987 Ohta et al.
5,000,667 A 3/1991 Taguchi et al.
5,644,968 A * 7/1997 Kimura et al. ..... 92/12.2

FOREIGN PATENT DOCUMENTS

| | | |
|---|---|---|
| DE | 34 16 638 C2 | 11/1988 |
| DE | 197 03 216 A1 | 8/1997 |
| DE | 196 21 174 A1 | 11/1997 |
| EP | 0 750 115 A1 | 12/1996 |
| JP | 4 143469 | 5/1992 |
| JP | 4 148083 | 5/1992 |

* cited by examiner

*Primary Examiner*—Edward K. Look
*Assistant Examiner*—Michael Leslie
(74) *Attorney, Agent, or Firm*—Andrus, Sceales, Starke & Sawall, LLP

(57) ABSTRACT

The invention relates to an axial piston displacement compressor, comprising a drive shaft (12), a disc (14) which is mounted on the drive shaft in such a way, that it can be pivoted about a pivotal axis (C) and at least one piston (18) which is provided with sliding blocks (20) that slide on a runway on the disc (14). The invention aims to reduce the maximum effective surface pressure between the disc (14) and the sliding blocks (20). To this end, the pivotal axis (C) of the disc (14) is located eccentrically in relation to the central plane of the disc.

6 Claims, 3 Drawing Sheets

AXIAL PISTON DISPLACEMENT COMPRESSOR

CROSS REFERENCE TO RELATED APPLICATION

The present application is the U.S. national stage application of International Application PCT/EP00/09705, filed Oct. 4, 2000, which international application was published on Apr. 12, 2001 as International Publication WO 01/25635 A1. The International Application claims priority of German Patent Application 199 47 677.2, filed Oct. 4, 1999.

STATE OF THE ART

The invention relates to an axial piston compressor with a drive shaft, a disc mounted on the drive shaft so that it can be tilted relative to the latter about a pivotal axis, and at least one piston provided with sliding blocks that move along a slideway on the disc.

Such an axial piston compressor can be used in particular in an air conditioner for motor vehicles. It serves to suck a coolant out of a heat-transfer compartment, in which the coolant evaporates while taking up heat, and to compress it to a higher pressure so that in another heat-transfer compartment the heat can be given off at a higher temperature level. Subsequently the coolant passes into an expansion organ, where it is returned to the pressure level of the first heat-transfer compartment.

For vehicle air conditioners coolant compressors of various constructions are employed. In recent years, for several reasons, axial piston compressors have come into general use, in particular because this construction enables an energetically favourable regulation of the output. That is, the compressor is customarily coupled directly to the motor by a belt drive, so that the operating conditions of the compressor cannot be adjusted as desired by changing the rotational speed of the compressor; for this reason the output is altered by tilting the disc, which determines the volume displaced by the compressor piston.

The stroke of each piston is produced by the cooperation between the sliding blocks connected to the piston and the disk, which can be pivoted relative to the drive shaft. When the disk is not tilted with respect to the drive shaft, i.e. the central axis of the disc coincides with the long axis of the drive shaft, there is no stroke, because the distance between, for example, the floor of the cylinder within which the piston is disposed and the bearing surface does not change when the drive shaft rotates. On the other hand, when the disc is tilted so that the angle between the central axis of the disc and the long axis of the drive shaft is different from zero, usually at most 20°, the distance between the bearing surface of the disc and the floor of the cylinder changes periodically between a minimal and a maximal value during each rotation of the drive shaft. Thus when the distance isminimal, the piston coupled to the disc is at its top-dead-centre position, i.e. is inserted maximally into the cylinder, whereas when the distance is maximal, the piston is at bottom dead centre.

The slideway, i.e. the path on the disc surface along which the sliding blocks mounted on the piston move, changes according to the angle at which the disc is tilted.

When the central axis of the disc coincides with the long axis of the drive shaft, the sliding blocks move over the disc along a circular slideway, the radius of which corresponds to the distance between the centre of the sliding blocks and the long axis of the drive shaft. In contrast, when the disc is tilted, the sliding blocks move along an elliptical slideway, because the distance between the middle of the sliding blocks and the long axis of the drive shaft is unchanged. The minor axis of the ellipse has a length corresponding to the radius of the circular slideway on a disc that is not tilted, and is parallel to the pivotal axis of the disc. The length of the major axis of the ellipse is equal to the radius divided by the cosine of the tilt angle of the disc.

To make the compressor compact, the pivotable disc is dimensioned so that when it is not tilted, there remains only a very small margin between the slideway of the sliding blocks and the outer edge of the disc. As a result, when the disc is tilted, the slideway overlaps the edge of the disc in the regions of the disc that correspond to the upper and the lower dead-centre points. This is a consequence of the apparent shortening of the disc when it is pivoted. Because of the fact that the slideway overlaps the edge when the disc is tilted, the area available to transfer the forces between disc and sliding blocks is reduced. Furthermore, in one of the positions in which the sliding blocks overlap the edge of the disc to the greatest extent, namely the position corresponding to the top-dead-centre point of the piston at the end of the compression stroke, the force exerted between the sliding blocks and the disc is maximal. Because the reduction of the area available for force transfer coincides with the maximum of the force to be transferred, the surface pressure between the disc and the sliding blocks increases, which in the extreme case can cause severe abrasion between these structures.

The objective of the invention is thus to improve an axial piston compressor of the kind described above in such a way that abrasion between the sliding blocks and the disc is reliably prevented under all operating conditions.

ADVANTAGES OF THE INVENTION

In an axial piston compressor in accordance with the invention, with the features cited in the characterizing part of claim 1, the pivotal axis of the disc is offset from the disc's central plane; as a result, a translational movement is superimposed on the rotational movement of the disc. The consequence is that when the disc is pivoted, it shifts relative to the sliding blocks, the position of which is fixed. This shifting can be used to alter the amount by which the sliding-block slideway overlaps the edge of the disc to a specific degree, either markedly reducing the overlap or eliminating it entirely. This reduces or eliminates the increase in surface pressure between sliding block and slideway.

Preferably it is provided that the displacement of the pivotal axis of the disc from the mid-plane of the disc is towards the side of the disc that faces the piston. In this configuration the reduction of contact area between the sliding blocks and the disc brought about by tilting of the disc is counteracted in the region corresponding to the top-dead-centre point of the associated piston, i.e. at the operating point at which the force acting on the piston is greatest. The reduction of contact area between sliding block and edge of the disc that does occur in this configuration, which is twice as great as in a configuration according to the state of the art (with a pivotal axis that coincides with the mid-plane of the disc), can be tolerated because at the corresponding time the force acting on the piston is comparatively slight. Even though the contact area between sliding blocks and disc surface is reduced, the resulting surface pressure is below the critical values.

According to one preferred embodiment of the invention the disc is a swash plate, which can be set into rotation by the drive shaft and the tilt angle of which with respect to the drive shaft can be adjusted. Such an axial piston compressor, which—apart from the translational movement that is superimposed on the rotational movement of the disc—corresponds to the structure known for example from the patent DE 197 03 216 A1, combines the advantage obtained in accordance with the invention, namely a reduction of surface pressure at certain times during operation such as the time when the force acting on the piston is maximal, with the advantage of relatively simple construction that this kind of structure provides.

According to an alternative preferred embodiment it is provided that the disc is a wobble plate, which is rotatably mounted on a swash plate and the tilt angle of which with respect to the drive shaft corresponds to that of the swash plate. This kind of structure, which—apart from the translational movement of the wobble plate that is superimposed on the rotational movement during pivoting—corresponds to a structure known for example from the patent DE 196 21 174 A1, combines the advantage of a targeted reduction of surface pressure with the advantage of particularly low-friction operation that this kind of structure provides.

According to a preferred embodiment of an axial piston compressor in accordance with the invention it is provided that with a distance of 30 mm between the long axis of the drive shaft and the long axis of the piston, an 8-mm diameter of the flat surfaces of the sliding blocks, which are apposed to the disc, and an angle of maximally 180 between the long axis of the drive shaft and the central axis of the disc, the distance between the mid-plane of the disc and the pivotal axis of the disc is about 1 mm. With this slight offset between pivotal axis and disc mid-plane, when the disc is tilted it is displaced relative to the slideway of the sliding blocks only far enough that on one side of the disc the degree to which the slideway overlaps the outer edge of the disc is reduced. Although it is theoretically possible to shift the disc so far that the slideway is confined entirely to the disc in the region of one dead-centre point of the piston, the invention is not intended to produce this effect; as the distance by which the pivotal axis is offset from the mid-plane of the disc increases, the centre of mass of the disc also moves away from the long axis of the drive shaft. The value given above, if the geometric relationships are as described, represents a good compromise between a reduction of surface pressure on one hand and an increased imbalance of the disc on the other hand.

Advantageous embodiments of the invention will be apparent from the subordinate claims.

DRAWINGS

In the following the invention is explained with reference to the attached drawings, wherein FIG. 1 is a schematic sectional view of an axial piston compressor according to the state of the art;

DESCRIPTION OF THE EXEMPLARY EMBODIMENT

Figure 1:
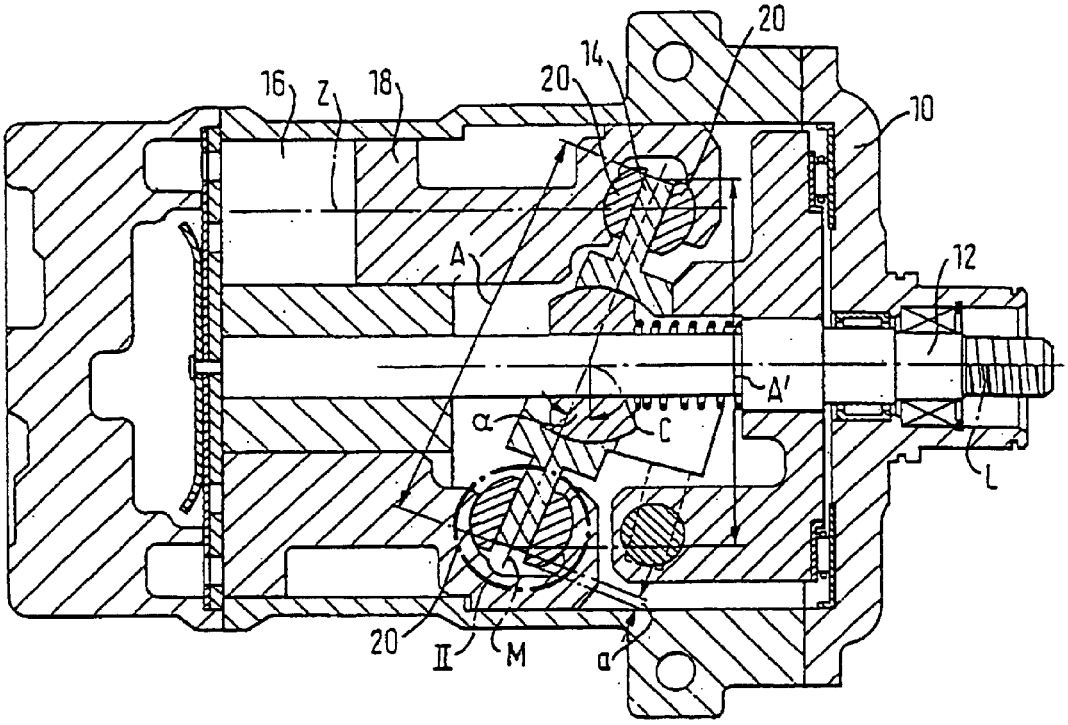
FIG. 1 ( Prior Art )
Figure 2:
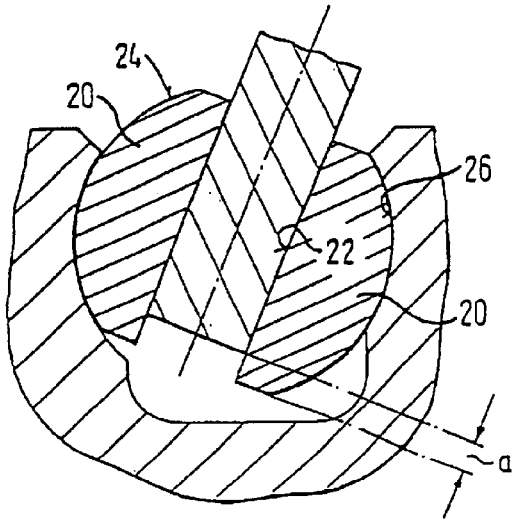
FIG. 2 (Prior Art)
FIG. 2 shows the detail II in FIG. 1 on a larger scale.

FIG. 1 shows an axial piston compressor according to the state of the art. It contains a housing 10 within which a drive shaft 12 is rotatably mounted. To the drive shaft 12 there is attached a swash plate 14, so that it cannot rotate on the shaft but can be pivoted about a pivotal axis C. The pivotal axis C intersects the long axis L of the drive shaft 12 at a right angle. The swash plate 14 can be pivoted about the axis C between an essentially untilted position, in which the angle between the mid-plane M of the swash plate 14 and a plane perpendicular to the long axis L of the drive shaft is about zero, and a maximally tilted position in which the angle $\alpha$ is about 20°. The means by which the change of position of the swash plate 14 is achieved and controlled are, firstly, generally known and furthermore are not relevant to understanding the invention, so that they will not be discussed here.

Within the housing there are several cylinders 16, in each of which a piston 18 is movably disposed. The long axis Z of each piston and each cylinder is parallel to the long axis L of the drive shaft. The compressor can be provided with up to seven such pistons, which are arranged around the drive shaft at uniform angular distances from one another.

Each piston is provided with two sliding blocks 20, each of, which comprises a circular flat surface 22 and a rotating surface 24 in the shape of a section of a sphere. The rotating surface of each sliding block 20 is seated within a correspondingly shaped receptacle 26 on the piston, in such a way that the swash plate 14 is retained between the flat surfaces 22 of the two sliding blocks of a piston, which face one another and are oriented in parallel. Accordingly, when the swash plate 14 is tilted at an angle $\alpha$ that is different from zero, the wobbly rotational movement of the swash plate is converted into a translational movement of the piston 18. In this process the flat surfaces 22 of the sliding blocks 20 run along slideways on the swash plate 14 that change position as the tilt angle $\alpha$ is changed. When the central axis of the swash plate 14 coincides with the long axis L of the drive shaft 12, so that the swash plate 14 extends perpendicular to the drive shaft 12, the sliding blocks 20 move along a circular slideway on the swash plate 14. The radius of this slideway corresponds to the distance between the centre of the ball-and-socket joint on each cylinder defined by the receptacles 26 and the long axis L. Because in the exemplary embodiment shown here the centre of each ball-and-socket joint coincides with the long axis Z of each cylinder 16, the radius of the slideway corresponds to the distance between the long axis Z and the long axis L. In contrast, when the swash plate is pivoted out of its position perpendicular to the drive shaft 12, the result is an elliptical slideway. The reason is that at the two dead-centre points of the piston, which are shown in FIG. 1, each flat surface is at a greater distance from the pivotal point C of the swash plate 14 than when it is in the intermediate positions, 90° away from the dead-centre points.

Figure 3:
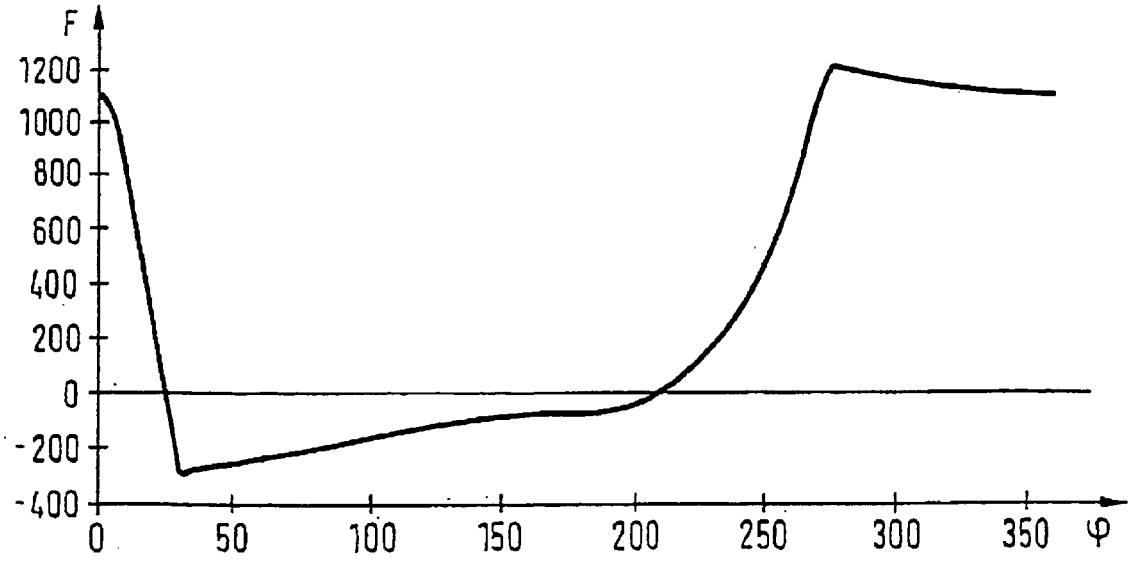
FIG. 3 is a diagram of the force acting on the piston as a function of angle of rotation.
Figure 4:
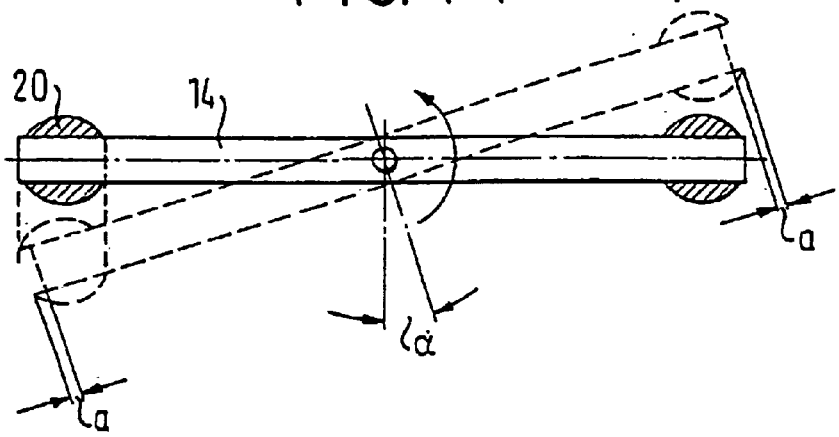
FIG. 4 (Prior Art)
FIG. 4 shows schematically the geometry between disc and sliding blocks in an axial piston compressor according to the state of the art.
Figure 5:
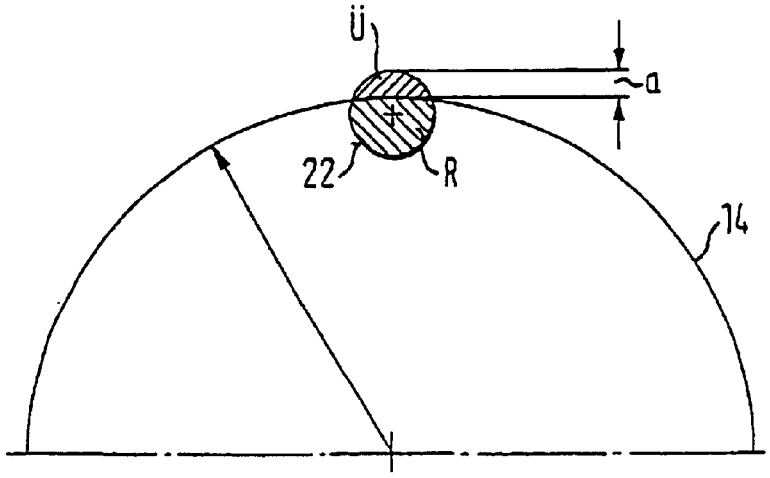
FIG. 5 (Prior Art)
FIG. 5 is another schematic drawing to show the geometric relationships in an axial piston compressor according to the state of the art.

To save space, the outside diameter A of the swash plate 14 is made such that in its untilted position the swash plate projects only slightly beyond the radially outer side of the sliding blocks 20; therefore, because when the swash plate 14 is tilted, its outside diameter appears to be shortened to the value A', the slideways of the sliding blocks 20 are no longer completely on the swash plate. Hence the flat surface 22 of the sliding block is no longer completely in contact with the swash plate 14. The amount by which the flat surface 22 projects beyond the outer edge of the swash plate 14 is indicated in the figures by "a". FIG. 4 shows the situation at the moment when the piston passes through the upper and the lower dead-centre point with the swash plate 14 tilted at the angle α. In FIG. 5 is a projection of a sliding block 20 and the swash plate 14 onto a plane perpendicular to the long axis L of the drive shaft 12 at the moment of passage through a dead-centre point of the piston. It is clear that the sliding block 20 extends beyond the periphery of the disc 14 by the distance a. Given a distance of 30 mm between the long axis Z of the piston and the long axis L of the drive shaft 12, an 8-mm diameter of the flat surface 22 of the sliding blocks 20, and a maximal tilt angle α of 18°, the geometric relationships are such that the overlap distance a=1.6 mm. Hence the area of the part of the surface not in contact with the swash plate 14 is 7.2 $mm^2$, whereas the remaining area R, which does contact the swash plate 14, is 43 $mm^2$. This means that almost 14.4% of the flat surface 22 of the sliding blocks 20 is not available for force transfer, so that the surface pressure in the region of the remaining area R increases accordingly. Matters are made worse by the fact that at each of the dead-centre points the flat surfaces 22 are tilted relative to the long axis Z of each cylinder, so that for the momentarily prevailing surface pressure the only area available is that of the projection of the flat surfaces onto a plane perpendicular to the long axis Z. Furthermore, when each piston is at its top-dead-centre point the force acting between that piston and the swash plate is maximal. In the diagram shown in FIG. 3, the force F acting on the piston is plotted as a function of the angle of rotation ϕ of the swash plate 14. The rotation angle ϕ=0° corresponds to the top-dead-centre point of a piston, i.e. the position in which it is inserted maximally into the cylinder 16. Starting from top dead centre, the piston is first accelerated in the direction of bottom dead centre, and coolant is simultaneously sucked in. For this reason, the forces acting on the piston are negative in some regions. Once the bottom-dead-centre point has been reached, i.e. at an angle of ϕ=180°, the compressive piston stroke occurs: the piston is accelerated towards top dead centre, causing the coolant to become compressed. During this process the forces that act on the piston are intensified, becoming maximal shortly before the top-dead-centre point is reached.

From this description of the changing force acting on the piston, in connection with the geometric relationships, it will be evident that the proportion of the flat surfaces 22 that is available for force transfer is minimal in the region of the lower dead-centre point, i.e. in the region of the transition from suction stroke to compression stroke. However, here the increase in surface pressure brought about by the fact that only part of the flat surface 22 makes contact with the swash plate 14 is not critical, because in this region relatively small forces are being transferred. In the region of the top-dead-centre point the flat surfaces of the sliding blocks project just as far beyond the edge of the swash plate 14, but it is here that the strongest forces must be transferred between the swash plate 14 and the sliding blocks 20; hence there is a critical increase in surface pressure between the flat surface 22 in this position and the corresponding part of the swash plate 14. This surface pressure can become so great as to cause severe abrasion between the swash plate 14 and the flat surface 22 of the sliding block 20.

Figure 6:
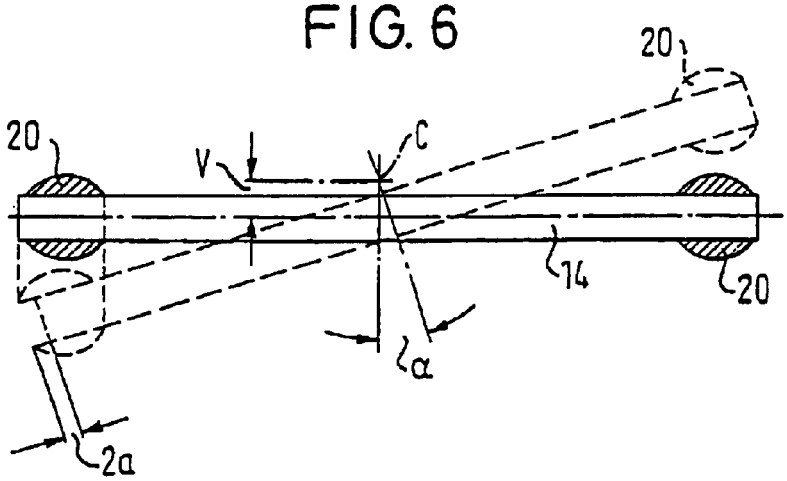
FIG. 6 is a schematic drawing of the geometric relationships in an axial piston compressor according to the invention.

The increased surface pressure just described, between the sliding blocks 20 and the swash plate 14 in the top-dead-centre region of the associated piston, can be reduced or eliminated by the configuration in accordance with the invention, which is shown schematically in FIG. 6. In contrast to the configuration known in the state of the art, here the pivotal axis C is offset from the mid-plane of the swash plate 14 by the dimension V. The offset V is such that the pivotal axis C is situated on the side of the swash plate 14 that faces the pistons (not shown in FIG. 6) that it drives. Because of the offset V, when the swash plate 14 is pivoted it makes a translational as well as a rotational movement. As a result, the outer edge of the swash plate 14 is eccentrically disposed with respect to its position at the dead-centre points of the pistons. By this means, the slideway 20 of the sliding blocks is again entirely confined to the surface of the swash plate 14 in the top-dead-centre region of the associated piston; the overlap distance a is equal to zero. Hence the entire area of the flat surface 22 is made available for transferring force. Set against this benefit is the fact that the overlap of the sliding block is doubled in the part of the slideway corresponding to the low-pressure point of the piston movement; however, the resulting increase in surface pressure is uncritical, because in the region of this low-pressure position of the piston only slight forces must be transferred.

In FIG. 6 the offset V of the pivotal axis C from the mid-plane of the swash plate 14 is exaggerated; in practice, given the above-mentioned dimensional relationships, an offset V of the order of 2 mm suffices to eliminate the overlap a at the top-dead-centre point of the piston.

Because of the reduced surface pressure between the sliding blocks and the swash plate under maximal load, the sliding block can in some circumstances be constructed with smaller dimensions, which enables the whole assembly to be made more compact. Furthermore, because the flat surface 22 of the sliding blocks 20 no longer projects beyond the edge of the swash plate 14 under maximal load, tension peaks and hence the wear and tear resulting from edge pressures are reduced. In the bottom-dead-centre region, the increased overlap a of the flat surface 22 improves the coverage of the flat surfaces of the sliding blocks by the lubricant mist in the interior of the housing 10.

When the pivotal axis C is disposed eccentrically with respect to the mid-plane of the swash plate, pivoting of the swash plate 14 causes the centre of mass of the swash plate to be eccentric with respect to the long axis L of the drive shaft. The result is a tendency towards slight imbalance while the compressor is in operation. Because these imbalances become more severe as the offset V increases, it can be provided as a compromise that the overlap a in the top-dead-centre region is not compensated entirely but only to such an extent that the surface pressure rises by a negligible amount. For example, with the geometric dimensions described above, an offset V of 1 mm will reduce the surface pressure in the top-dead-centre region by about 10% in comparison to the state of the art, while at the same time the centre of mass of the swash plate 14 is shifted away from the long axis L of the drive shaft by only 0.3 mm.

The principle in accordance with the invention described above, namely the tilting of a disc about a pivotal axis disposed eccentrically with respect to the mid-plane of this disc, can of course also be applied to axial piston compressors in which the sliding blocks of the pistons do not interact directly with the swash plate itself, but rather make contact with a wobble plate rotatably mounted on the swash plate.

List of Reference Symbols

10: Housing
12: Drive shaft
14: Swash plate
16: Cylinder
18: Piston
20: Sliding block

22: Flat surface
24: Rotating surface
26: Receptacle
A: Outside diameter of swash plate
A': Apparent outside diameter of swash plate
C: Pivotal axis
L: Long axis of drive shaft
R: Remaining surface
Ü: Overlapping surface
V: Offset
Z: Long axis of piston and cylinder
α: Tilt angle
ϕ: Rotational angle of swash plate

What is claimed is:

1. Axial piston compressor with a drive shaft (12) for a disc (14) that is mounted on the drive shaft in such a way that it can be tilted relative to the drive shaft about a pivotal axis (C), and at least one piston (18), wherein the pivotal axis (C) of the disc (14) is disposed eccentrically with respect to the mid-plane of the disc, characterized in that the piston (18) is provided with at least two sliding blocks (20) that move the disc (14) axially on a slideway, arranged such that the piston (18) encloses the sliding blocks (20) in a C-shaped structure, and that the position of the pivotal axis (C) relative to the mid-plane of the disc is on the side that faces the piston (18), so that the disc (14) can be independently tilted relative to the sliding blocks (20) in such a way that the slideway of the sliding blocks projects beyond the edge of the disc only slightly or not at all whereby a constant pivotal axis is defined for the disc.

2. Axial piston compressor according to claim 1, characterized in that the disc is a swash plate (14), which can be set into rotation by the drive shaft (12) and can be adjusted to various tilt angles (α) with respect to the drive shaft.

3. Axial piston compressor according to claim 1, characterized in that, given a distance of 30 mm between the long axis (L) of the drive shaft and the long axis (Z) of the piston, an 8-mm diameter of the flat surface (22) of the sliding blocks (20), which is opposed to the slideway, and a maximal tilt angle (α) of 18° between the long axis of the drive shaft and the central axis of the disc, the distance between the mid-plane of the disc and the pivotal axis of the disc (14) is no greater than about 1 mm.

4. Axial compressor according to claim 2, characterized in that, given a distance of 30 mm between the long axis (L) of the drive shaft and the long axis (Z) of the piston, an 8-mm diameter of the flat surface (22) of the sliding blocks (20), which is opposed to the slideway, and a maximal tilt angle (α) of 18° between the long axis of the drive shaft and the central axis of the disc, the distance between the mid-plane of the disc and the pivotal axis of the disc (14) is no greater than about 1 mm.

5. Axial piston compressor with a drive shaft (12) for a disc (14) that is mounted on the drive shaft in such a way that it can be tilted relative to the drive shaft about a pivotal axis (C), and at least one piston (18), wherein the pivotal axis (C) of the disc (14) is disposed eccentrically with respect to the mid-plane of the disc, characterized in that the piston (18) is provided with at least two sliding blocks (20) that move the disc (14) axially on a slideway, arranged such that the piston (18) encloses the sliding blocks (20) in a C-shaped structure, and that the position of the pivotal axis (C) relative to the mid-plane of the disc is on the side that faces the piston (18), so that the disc (14) can be independently tilted relative to the sliding blocks (20) in such a way that the slideway of the sliding blocks projects beyond the edge of the disc only slightly or not at all whereby a constant pivotal axis is defined for the disc, and given a distance of 30 mm between the long axis (L) of the drive shaft and the long axis (Z) of the piston, an 8-mm diameter of the flat surface (22) of the sliding blocks (20), which is opposed to the slideway, and a maximal tilt angle (α) of 18° between the long axis of the drive shaft and the central axis of the disc, the distance between the mid-plane of the disc and the pivotal axis of the disc (14) is no greater than about 1 mm.

6. Axial piston compressor with a drive shaft (12) for a disc (14) that is mounted on the drive shaft in such a way that it can be tilted relative to the drive shaft about a pivotal axis (C), and at least one piston (18), wherein the pivotal axis (C) of the disc (14) is disposed eccentrically with respect to the mid-plane of the disc, characterized in that the piston (18) is provided with at least two sliding blocks (20) that move the disc (14) axially on a slideway, arranged such that the piston (18) encloses the sliding blocks (20) in a C-shaped structure, and that the position of the pivotal axis (C) relative to the mid-plane of the disc is on the side that faces the piston (18), so that the disc (14) can be independently tilted relative to the sliding blocks (20) in such a way that the slideway of the sliding blocks projects beyond the edge of the disc only slightly or not at all whereby a constant pivotal axis is defined for the disc, given a distance of 30 mm between the long axis (L) of the drive shaft and the long axis (Z) of the piston, an 8-mm diameter of the flat surface (22) of the sliding blocks (20), which is opposed to the slideway, and a maximal tilt angle (α) of 18° between the long axis of the drive shaft and the central axis of the disc, the distance between the mid-plane of the disc and the pivotal axis of the disc (14) is no greater than about 1 mm.

* * * * *